US009896817B2

(12) United States Patent
Sulzer et al.

(10) Patent No.: US 9,896,817 B2
(45) Date of Patent: Feb. 20, 2018

(54) COUPLER ASSEMBLY FOR RELEASABLY COUPLING A WORK MACHINE TO WORK TOOL AND METHOD THEREOF

(71) Applicant: DEERE & COMPANY, Moline, IL (US)

(72) Inventors: Daniel M. Sulzer, Dubuque, IA (US); Arun Narayanan, Pune (IN); Gregory A. Kittle, Rockford, IL (US); Cory A. Ott, Eden Prairie, MN (US)

(73) Assignee: DEERE & COMPANY, Moline, IL (US)

( * ) Notice: Subject to any disclaimer, the term of this patent is extended or adjusted under 35 U.S.C. 154(b) by 436 days.

(21) Appl. No.: 14/674,451

(22) Filed: Mar. 31, 2015

(65) Prior Publication Data

US 2016/0289914 A1 Oct. 6, 2016

(51) Int. Cl.
*E02F 3/36* (2006.01)
*E02F 9/26* (2006.01)

(52) U.S. Cl.
CPC ..... *E02F 3/3622* (2013.01); *E02F 3/365* (2013.01); *E02F 3/3618* (2013.01); *E02F 3/3645* (2013.01); *E02F 3/3672* (2013.01); *E02F 9/26* (2013.01)

(58) Field of Classification Search
CPC ..... E02F 3/3622; E02F 9/26; E02F 3/3672; E02F 3/3645; E02F 3/3618; E02F 3/365
See application file for complete search history.

(56) References Cited

U.S. PATENT DOCUMENTS

| | | | | |
|---|---|---|---|---|
| 4,187,050 | A * | 2/1980 | Barbee | E02F 3/3622 172/272 |
| 4,295,287 | A | 10/1981 | Natzke et al. | |
| 5,116,683 | A | 5/1992 | Vail | |
| 8,007,197 | B2 | 8/2011 | Nye et al. | |
| 8,974,137 | B2 | 3/2015 | Parker et al. | |
| 9,284,712 | B2 | 3/2016 | Bradley et al. | |
| 2007/0166143 | A1 | 7/2007 | Hart et al. | |
| 2010/0067982 | A1 * | 3/2010 | Hill | E02F 3/3622 403/321 |
| 2013/0318841 | A1 | 12/2013 | Robl et al. | |

* cited by examiner

*Primary Examiner* — Michael S Lowe
(74) *Attorney, Agent, or Firm* — Taft Stettinius & Hollister LLP; Stephen F. Rost

(57) ABSTRACT

A coupler assembly for coupling a work tool to a work machine. The assembly includes a body, a first locking mechanism, and a second locking mechanism. The first locking mechanism is pivotable about a pivot from a first position to a second position and is configured to be coupled to the work tool in the first position and decoupled in the second position. The second locking mechanism includes a pin having a first end and a second end, a tab coupled to the pin proximate the second end, and a spring disposed between the first end and the second end. The second locking mechanism is axially and pivotably movable about an axis such that the second locking mechanism includes a locked position and an unlocked position. As the first locking mechanism moves from the second position to the first position, the second locking mechanism automatically moves to the locked position.

20 Claims, 15 Drawing Sheets

COUPLER ASSEMBLY FOR RELEASABLY COUPLING A WORK MACHINE TO WORK TOOL AND METHOD THEREOF

FIELD OF THE DISCLOSURE

The present disclosure relates to a coupler assembly of a work machine, and in particular, a coupler assembly including a plurality of locking mechanisms for releasably coupling a work tool to a work machine.

BACKGROUND

Many conventional work machines, such as those in the construction and forestry industries, perform various tasks such as craning or digging functions. To perform some of these functions, machines may include a work tool removably coupled to a boom arm. The work tool may include a blade, bucket, etc. A coupler may be used for removably coupling one or more work tools to the boom arm.

SUMMARY

In one embodiment of the present disclosure, a coupler assembly is provided for coupling a work tool to a work machine. The coupler assembly includes a body having a front end and a rear end; a first locking mechanism pivotable about a pivot from a first position to a second position, the first locking mechanism configured to be coupled to the work tool in the first position and decoupled in the second position; and a second locking mechanism including a pin having a first end and a second end, a tab coupled to the pin proximate the second end, and a spring disposed between the first end and the second end, where the second locking mechanism is axially and pivotably movable about an axis; wherein, the second locking mechanism is movable between a locked position and an unlocked position; further wherein, as the first locking mechanism moves from the second position to the first position, the second locking mechanism automatically moves to the locked position.

In one example of this embodiment, the first locking mechanism is maintained in the first position in the locked position. In a second example, as the second locking mechanism is moved from the locked position to the unlocked position, the pin is axially moved to an outward position from its locked position and the tab is rotated to a position whereby at least one of the second end and the tab is in contact with the first locked mechanism to maintain the pin in the outward position. In a third example, the first locking mechanism is movable between the first and second positions in the unlocked position. In a fourth example, a second spring coupled to the first locking mechanism.

In a fifth example, the coupler assembly includes a spring support pivotably coupled to the first locking mechanism; and a retainer fixedly coupled to the body; wherein, the second spring is disposed between the spring support and retainer. In a sixth example, the body defines a longitudinal axis that passes through the pivot, and the second spring is disposed below the axis in the first position and above the axis in the second position. In a seventh example, the first locking mechanism remains in the second position when the second spring is disposed above the axis. In an eighth example, the second locking mechanism automatically moves to its locked position once a trailing edge of the first locking mechanism moves past the pin and the pin is releasably disengaged from contacting the first locking mechanism.

In another example of this embodiment, the spring biases the pin from its outward position to an inward position once the pin is no longer in contact with the first locking mechanism. In a further example, a hook portion is defined at the front end of the body, the hook portion being configured to be releasably coupled to the work tool. In a different example, in the second position, the hook portion is coupled to the work tool until the body is rotated to a position that releases the work tool from the hook portion.

In a further embodiment, a work machine includes a frame supported by at least one ground-engaging mechanism; a cab mounted to the frame, the cab including at least one control element for controlling a function of the machine; a work tool controllable for performing a work function; a coupler assembly for coupling the work tool to the work machine, the coupler assembly including a body having a front end and a rear end; a first locking mechanism pivotable about a pivot from a first position to a second position, the first locking mechanism configured to be coupled to the work tool in the first position and decoupled in the second position; and a second locking mechanism including a pin having a first end and a second end, a tab coupled to the pin proximate the second end, and a spring disposed between the first end and the second end, where the second locking mechanism is axially and pivotably movable about an axis; wherein, the second locking mechanism is movable between a locked position and an unlocked position; further wherein, as the first locking mechanism moves from the second position to the first position, the second locking mechanism automatically moves to the locked position.

In one example of this embodiment, in the second position, the coupler assembly is controllably rotated via a hydraulic cylinder to disengage the work tool from the coupler assembly. In a second example, in the locked position, the first locking mechanism is maintained in the first position; and in the unlocked position, the first locking mechanism is movable between the first and second positions. In a third example, as the second locking mechanism is moved from the locked position to the unlocked position, the pin is axially moved to an outward position from its locked position and the tab is rotated to a position whereby at least one of the second end and the tab is in contact with the first locked mechanism to maintain the pin in the outward position.

In a fourth example, the machine includes a spring support pivotably coupled to the first locking mechanism; a retainer fixedly coupled to the body; and a second spring coupled to the spring support and retainer to maintain a compressive force against the first locking mechanism. In a fifth example, the body defines a longitudinal axis that passes through the pivot; further wherein, the second spring is disposed below the axis in the first position and above the axis in the second position. In a sixth example, the first locking mechanism remains in the second position when the second spring is disposed above the axis. In a seventh example, the second locking mechanism automatically moves to its locked position once a trailing edge of the first locking mechanism moves past the pin and the pin and tab are releasably disengaged from contacting the first locking mechanism. In an eighth example, a hook portion is defined at the front end of the body, the hook portion being configured to be releasably coupled to the work tool.

In a different embodiment, a method is provided for decoupling a work tool from a work machine. The method includes providing a coupler assembly including a body, a spring, a first locking mechanism, and a second locking mechanism, the second locking mechanism including a pin having a first end and a second end, and a tab coupled to the pin at the second end; moving the pin axially outwardly from its locked position; rotating the pin until the second locking mechanism contacts the first locking mechanism; pivoting the first locking mechanism about a pivot; moving the first spring from a position below an axis passing through the pivot to a position above the axis; releasing a pin of the work tool from the first locking mechanism; and decoupling the work tool from the work machine.

In one example of this embodiment, the method includes unlocking the second locking mechanism after the rotating step. In a different example, the pin is rotated until the tab contacts a plug coupled to the first locking mechanism. In a third example, the method includes inserting a tool into an opening formed in the first locking mechanism; rotating the tool in a downward position; and moving the first locking mechanism from a first position to a second position; wherein, the pin is released from the first locking mechanism in the second position. In a fourth example, the method includes maintaining contact between the first and second locking mechanisms in the second position.

In a fifth example, the method includes compressing the first spring between the coupler assembly and the first locking mechanism. In a sixth example, the method includes maintaining a second pin of the work tool coupled to the coupler assembly at a front end of the body after the releasing step. In a seventh example, the method includes pivoting the coupler assembly to release the coupler assembly from the second pin before the decoupling step.

In another embodiment of the present disclosure, a method is provided for coupling a work tool to a work machine. The method includes providing a coupler assembly including a body, a spring, a first locking mechanism, and a second locking mechanism, the second locking mechanism including a pin having a first end and a second end, a tab coupled to the pin at the second end, and a second spring; positioning the first locking mechanism is an open position and the second locking mechanism in an unlocked position relative to the first locking mechanism; contacting the first locking mechanism with the work tool; triggering the first locking mechanism to rotate about a pivot; rotating the first locking mechanism about the pivot to couple the work tool to the first locking mechanism; automatically releasing the second locking mechanism from contact with the first locking mechanism; moving the second locking mechanism from its unlocked position to a locked position; and coupling the work tool to the work machine.

In one example, the moving step includes decompressing a second spring of the second locking mechanism after the releasing step. In a second example, the rotating step includes rotating the first locking mechanism from an open position to a closed position. In a third example, the method includes enabling the first locking mechanism to rotate about the pivot when the second locking mechanism is disposed in the unlocked position; and preventing the first locking mechanism from rotating about the pivot when the second locking mechanism is disposed in the locked position. In a fourth example, the method includes disposing the second locking mechanism outwardly from the body in the unlocked position; and disposing the second locking mechanism inwardly from the body in the locked position.

In a fifth example, the method includes positioning the spring above a longitudinal axis passing through the pivot before the rotating step. In a sixth example, the method includes moving the spring from above the axis to below the axis during the rotating step. In a seventh example, the method includes engaging a hooked portion of the coupler assembly with the work tool before the contacting step. In an eighth example, the method includes pivoting the coupler assembly about the work tool after the engaging step in order to perform the contacting step. In a ninth example, the method includes coupling the work tool at a first end of the body via the hooked portion and at a second end via the first locking mechanism, the first end and second end being spaced from one another. In another example, the method includes disposing the tab at a location behind the first locking mechanism in the locked position.

In yet a further embodiment, a coupler assembly for coupling a work tool to a work machine is provided. The coupler assembly includes a pair of longitudinal bodies having a front end and a rear end; a plate coupled between the pair of bodies at the rear end thereof, wherein the plate includes a slot defined therein; a hook portion formed at the front end of the pair of bodies, the hook portion defining a first cavity adapted to receive to a first pin of the work tool; a first locking mechanism defining a plurality of openings and including a finger portion, the finger portion partially defining a second cavity adapted to receive a second pin of the work tool; a pivot pin disposable in one of the plurality of openings of the first locking mechanism, the pivot pin pivotably coupling the first locking mechanism to the pair of bodies to enable the first locking mechanism to pivot about a first pivot axis; a first spring having a first end and a second end, the first end being pivotably coupled to the first locking mechanism about a second pivot axis; and a second locking mechanism including a pin having a first end and a second end, a tab coupled to the pin proximate the second end, and a second spring disposed between the first and the second ends, where the second locking mechanism is axially and pivotably movable about an axis; wherein, the first locking mechanism is pivotable about the first pivot axis between a first position and a second position, and the second locking mechanism is movable between a locked position and an unlocked position; further wherein: in the first position, the first locking mechanism is configured to be coupled to the second pin of the work tool and the tab is disposed to the rear of the first locking mechanism to block the first locking mechanism from pivoting from its first position and the second locking mechanism is disposed in its locked position; and in the second position, the first locking mechanism is pivotably displaced from the first position such that the finger portion is configured to be at least partially disposed between the pair of bodies and the second pin, and the second locking mechanism is disposed axially outward in its unlocked position and in contact with the first locking mechanism.

In one example of this embodiment, the coupler assembly includes a spring support pivotably coupled to the first locking mechanism; and a retainer fixedly coupled to the pair of bodies; wherein, the first spring is disposed between the spring support and retainer. In a second example, one of the pair of bodies defines a longitudinal axis that passes through the first pivot axis; further wherein, the first spring is disposed below the longitudinal axis in the first position and above the longitudinal axis in the second position. In a third example, the second locking mechanism automatically moves to its locked position from its unlocked position once a trailing edge of the first locking mechanism moves past the pin, the pin is releasably disengaged from contacting the first locking mechanism, and the second spring biases the second locking mechanism inwardly such that the tab is disposed rearward of the first locking mechanism.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
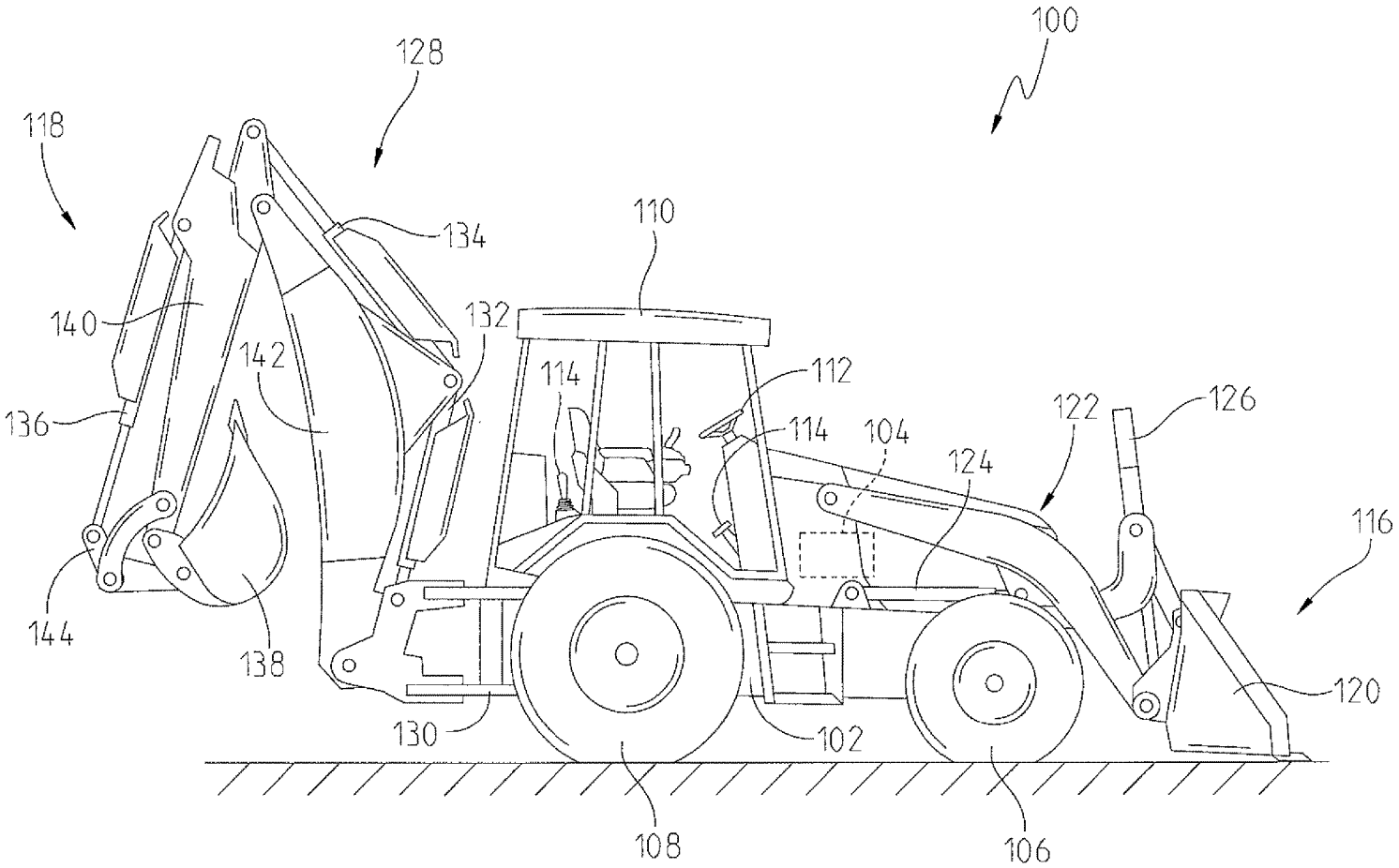
FIG. 1 is a side view of a machine.

An example embodiment of a work machine is shown in FIG. 1. The machine is illustrated as a loader backhoe 100. The present disclosure is not limited, however, to a loader backhoe and may extend to other work machines such as an excavator, crawler, harvester, skidder, motor grader, or any other work machine. As such, while the figures and forthcoming description may relate to a loader backhoe, it is to be understood that the scope of the present disclosure extends beyond a loader backhoe and, where applicable, the term "machine" or "work machine" will be used instead. The term "machine" or "work machine" is intended to be broader and encompass other vehicles besides a loader backhoe for purposes of this disclosure.

Referring to FIG. 1, the machine 100 includes a chassis 102 forming a frame structure. A power source or engine 104 can provide power to a plurality of traction devices, illustratively front wheels 106 and rear wheels 108. It is also within the scope of the present disclosure that the traction devices of vehicle 100 may include belts or steel tracks, for example. In use, engine 104 drives the front and/or rear wheels 106 and 108 via a transmission (not shown), causing vehicle 100 to propel across the ground.

The machine 100 of FIG. 1 may also include an operator cab 110 supported by the chassis 102 to house and protect the operator of the machine 100. The operator cab 110 may include a plurality of controls for operating the machine. In FIG. 1, a steering wheel 112 may be used to manipulate a direction of travel of the machine 100. In addition, other controls 114 such as joysticks, pedals, switches, buttons, and the like may be used for controlling one or more work functions of the machine 100.

The machine 100 may include a loader assembly 116 disposed at a front end and a backhoe assembly 118 at a rear end thereof. The machine 100 may further include at least one work tool, illustratively a first work tool 120 (i.e., a loader bucket) coupled to the loader assembly 116 and a second work tool 138 (i.e., a backhoe bucket) coupled to the backhoe assembly 118. Other suitable work tools may be used such as, for example, blades, forks, tillers, and mowers. Work tools 120 and 138 are moveably coupled to chassis 102 for scooping, carrying, and dumping dirt and other materials.

As shown in FIG. 1, the first work tool 120 is moveably coupled to the front end of chassis 102 via a first boom assembly 122, which includes a plurality of hydraulic actuators for moving the first work tool 120 relative to chassis 102. The illustrative first boom assembly 122 includes hydraulic lift cylinders 124 for raising and lowering the first boom assembly 122 and a hydraulic tilt cylinder 126 for tilting (e.g. digging and dumping) the first work tool 120.

The second work tool 138 is moveably coupled to the rear end of chassis 102 via a second boom assembly 128, which includes a dipper arm 140, a boom arm 142, a linkage assembly 144, and a plurality of hydraulic actuators for moving the second work tool 138 relative to chassis 102. The illustrative second boom assembly 128 may include a plurality of hydraulic swing cylinders 130 for swinging the second boom assembly 128 side to side, a hydraulic lift cylinder 132 for raising and lowering the second boom assembly 128, a hydraulic crowd cylinder 134 for bending the second boom assembly 128, and a hydraulic tilt cylinder 136 for tilting (e.g. digging and dumping) the second work tool 138. The operator may control movement of the first and second work tools using controls 114 located within operator cab 110.

Figure 2:
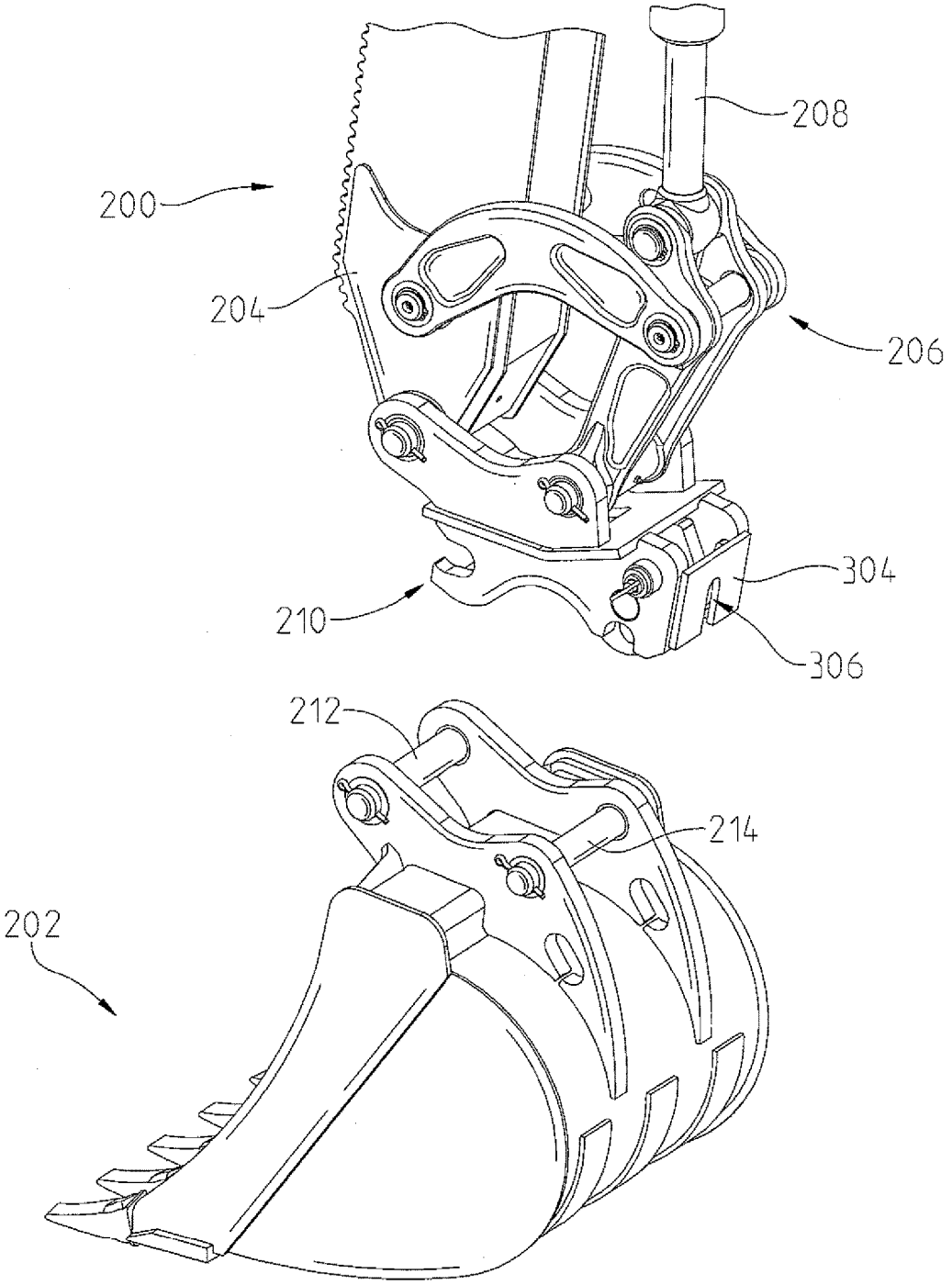
FIG. 2 is a side perspective view of a portion of a boom assembly and a work tool.

Referring to FIG. 2, a portion of a work machine 200 is shown. In particular, a dipper arm 204 is shown extending downwardly from a boom arm (not shown). A linkage assembly 206 is pivotably coupled to the dipper arm 204, and a coupler assembly 210 is coupled to the linkage assembly 206. A hydraulic actuator 208 similar to the hydraulic tilt actuator 136 of FIG. 1 is also shown. The hydraulic actuator 208 can be actuated via one or more controls 114 from the operator's cab 110. By actuating the hydraulic actuator 208, the linkage assembly 206 and coupler assembly 210 can be operably controlled for performing a work function.

In one example, a work tool 202 such as a bucket may be removably coupled to the coupler assembly 210. The work tool 202 may include a first pin 212 and a second pin 214. The first pin 212 may be disposed towards a front end of the work tool 202, whereas the second pin 214 may be disposed towards a rear end thereof. In any event, an operator may operate the controls 114 in order to couple the coupler assembly 210 to the work tool 202. This will be further described in this disclosure.

In conventional work machines such as a backhoe, there may be two mechanisms for locking or coupling a work tool to the machine. The machine can be controlled to couple one mechanism to the work tool, but the second mechanism usually requires the operator to exit the machine and manually manipulate the second mechanism for coupling to the work tool. Government safety regulations may require both mechanisms to be coupled to the work tool before the machine is operated. However, there is often no means to prevent the machine from being operated without both mechanism disposed in their respective locked conditions. In other words, if an operator does not want to exit the machine after locking the first mechanism to the work tool, there is nothing in place to prevent the machine from being operated.

Given that it is inefficient and unproductive to require the operator to exit the machine each time a new work tool is coupled thereto, a need exists to be able to automatically actuate the second mechanism to couple or lock the machine to the work tool. As will be described herein, the coupler assembly 210 is a spring-based assembly that provides an automatic locking mechanism for securing the work tool to the machine without requiring a machine operator to exit the machine and manually couple or lock the machine to the tool. In addition, the coupler assembly 210 further provides visual confirmation to the operator that the coupler assembly is disposed in either its unlocked or locked configuration.

Figure 3:
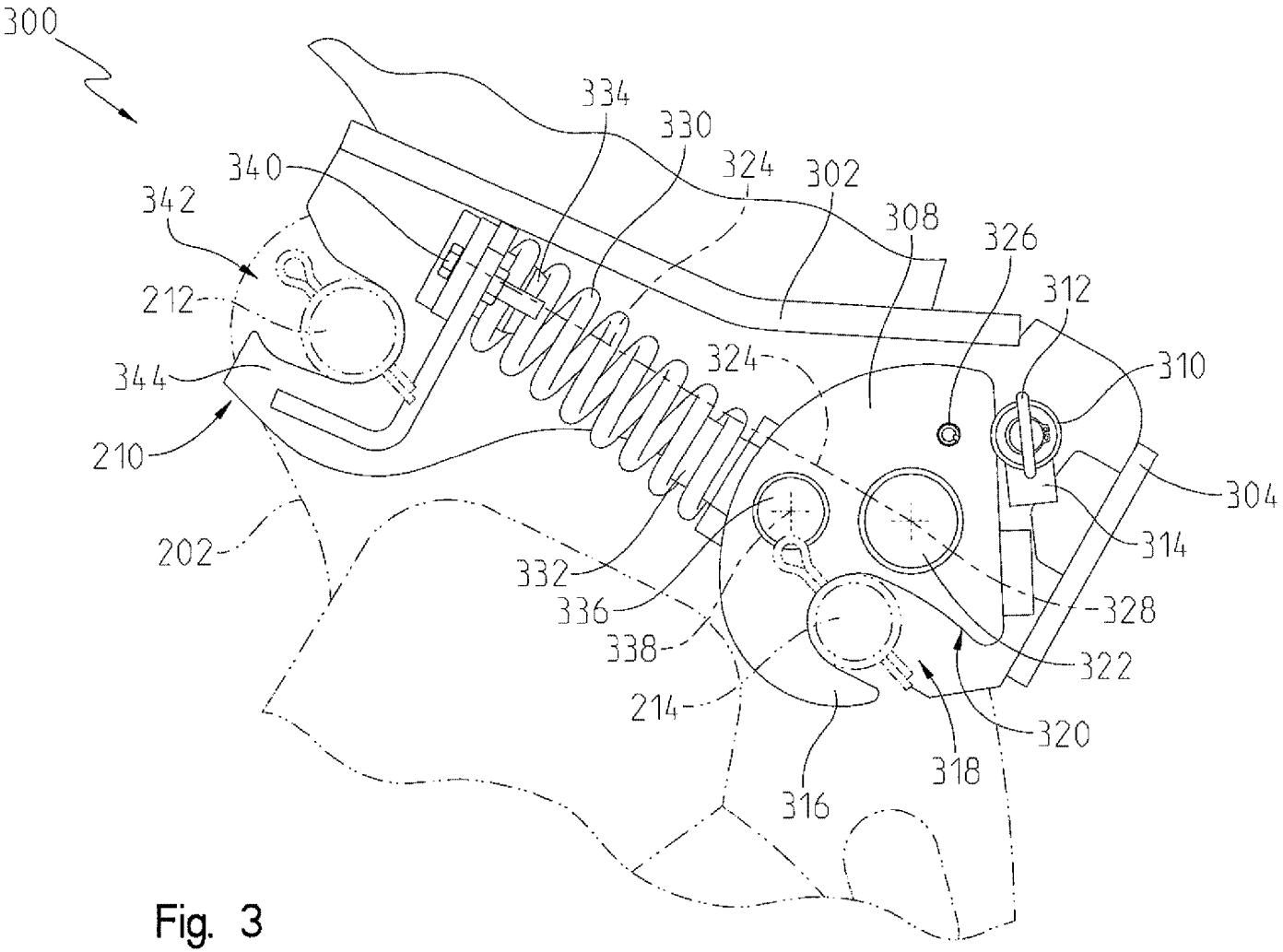
FIG. 3 is a partial side view of a coupler assembly for coupling the boom assembly of FIG. 2 with the work tool.
Figure 13:
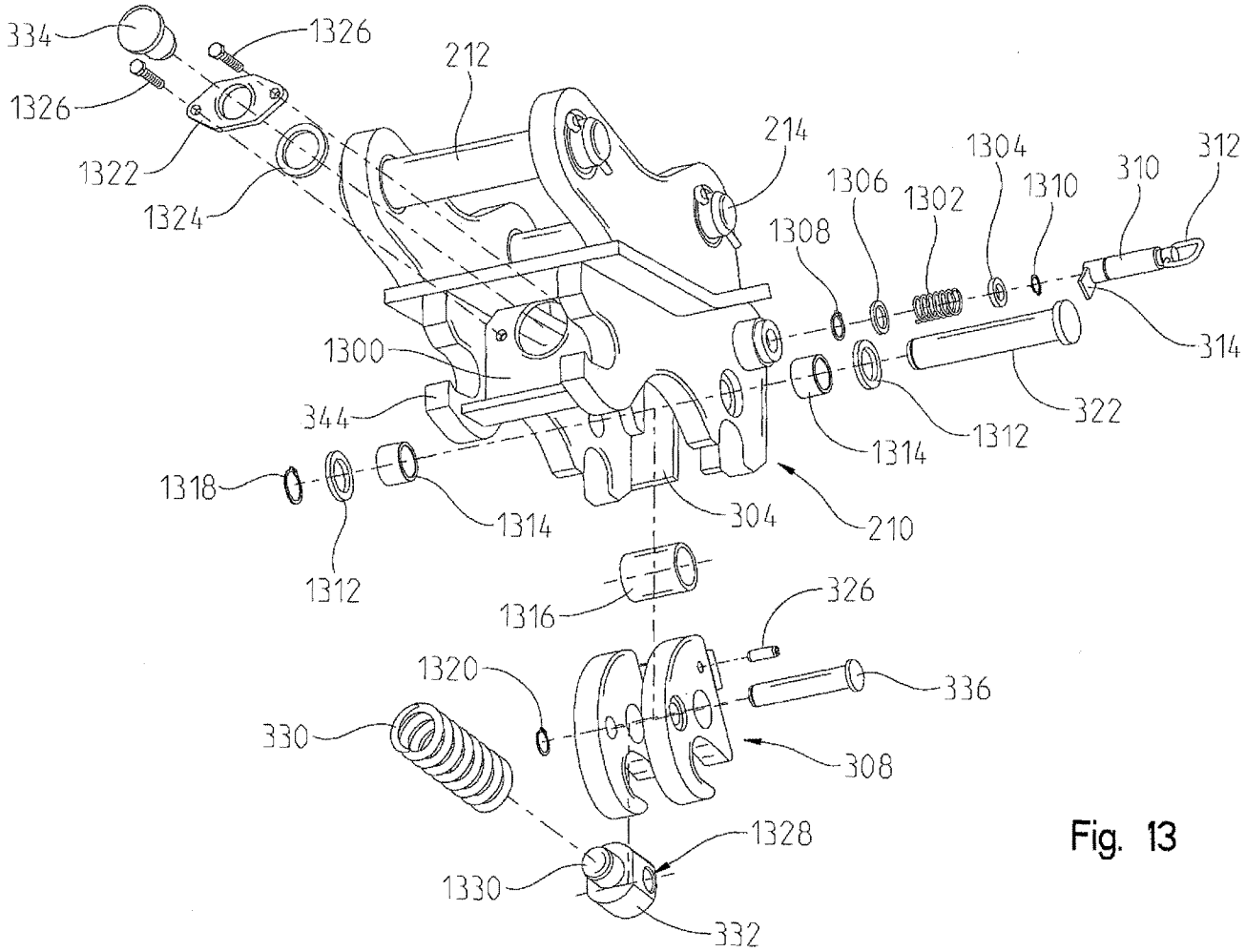
FIG. 13 is an exploded view of the coupler assembly of FIG. 3.

Referring to FIGS. 3 and 13, one illustrated embodiment of the coupler assembly 210 is shown. The coupler assembly 210 includes a pair of elongated bodies 302 spaced from one another. A first plate 304 may be coupled between the pair of bodies 302 at a rear of the coupler assembly 210, whereas a second plate 1300 may be coupled therebetween at a front of the assembly 210. Each plate may be welded, for example, to the pair of elongated bodies 302. As shown in FIG. 2, the first plate 304 may include a defined slot 306 therein. The slot 306 may be substantially U-shaped. The shape of the defined slot 306, however, may be oval, rectangle, square, or the like.

The coupler assembly 210 includes a front end defined by a pair of hook arms 344. The hooks arms 344 form a cavity 342 for receiving the second pin 214 of the work tool 202. The assembly 210 may include a rear end that includes a first locking mechanism 308 and a second locking mechanism 310. The first locking mechanism 308 is pivotably coupled to the bodies 302 via a pivot pin 322. The pivot pin 322 may be an elongated pin that is positioned within an opening formed in each body 302, and the first locking mechanism 308 may pivot about a first pivot axis 328. The pivot pin 322 may include an enlarged head at one end and a retaining ring 1318 may be used to fasten the pin 322 at an opposite end thereof. Between the enlarged head and retaining ring, a pair of washers 1312, a pair of bearings 1314, and a spacer bearing 1316 may be disposed between the first locking mechanism 308 and pivot pin 322.

The second locking mechanism 310 may be formed by an elongate pin 312 that passes through an opening formed in one of the bodies 302. The opening for the pin 312 of the second locking mechanism 310 may be spaced from the opening for the pivot pin 322, but the location of each is generally towards the rear of the coupler assembly 210. The second locking mechanism 310 may further include a tab 314 that is coupled thereto. For instance, the tab 314 may be welded to the pin 312. The tab 314 may extend at a direction that is at least partially perpendicular to a longitudinal axis defined by the pin 312. The tab 314 may be coupled at one end of the pin 312, whereas a handle is coupled at the opposite end thereof. The pin 312 therefore is pivotably and axially movable relative to the pair of bodies 302.

In addition, the second locking mechanism 310 may include a spring 1302 that biases the pin 312 towards a position defined inwardly of the bodies 302. This will be described in greater detail below. The spring 1302 is disposed between a first ring 1304 and a first retaining ring 1310 at one end and a second ring 1306 and a second retaining ring 1308 at an opposite end thereof. For example, the first ring 1304 and first retaining ring 1310 may be disposed nearest the handle, whereas the second ring 1306 and second retaining ring 1308 may be disposed nearest the tab 314. As previously described, the spring 1302 is disposed between the rings and retaining rings and is compressed when the pin 1312 is moved axially outward and away from the coupler assembly 210. In some aspects, the spring 1302 may constantly be compressed when assembled with the pin 312, and when the pin 312 is pulled outwardly it further compresses the spring 1302.

The first locking mechanism 308 may be formed by a pair of bodies as shown in FIG. 13. Each body includes a plurality of openings defined therein, one of which is for the pivot pin 322 as previously described. Each body of the first locking mechanism 308 includes a crescent-shaped finger 316 that has a curvature for defining a cavity 318. The cavity 318, as shown in FIG. 3, is formed partially by the inner surface of the finger 316 along one side and an inner surface 320 of the body along an opposite side. The cavity 318 may be defined as a longitudinal channel having a width that is approximately the diameter of the second pin 214. In some embodiments, the width may be slightly larger than the diameter of the second pin 214 for a secure engagement. In other embodiments, the width may be much larger than the diameter of the pin 214. In any event, when coupling the coupler assembly 210 to the work tool 202, the second pin 214 is received within the cavity 318. As will be described below, the finger 316 may be pivoted to further secure the second pin 214 of the work tool 202 within the cavity 316 in the coupled position.

A plug 326 formed by an elongate pin may also be coupled to an opening defined in one of the bodies of the first locking mechanism 308. When assembled, a portion of the plug 326 may extend out of the opening. This will be further described below.

The coupler assembly 210 may be referred to as a spring-type coupler assembly. As shown in FIGS. 3-13, the coupler assembly 210 may include a spring 330. The spring 330 may be a coil spring, toroidal spring, bevel spring, or any other known type of spring. The spring may apply a continuous spring force against the first locking mechanism 308. This spring force may vary based on the position of the first locking mechanism 308 and spring 330.

The spring 330 includes a first end and a second end. The first end may be coupled to a spring support 332 and the second end may be coupled to a retainer 334. The spring support 332 forms a body that may include an extended portion 1330 that fits within the spring 330. The body of the spring support 332 may further define an opening 1328 for receiving a pin 336. The pin 336 defines a second pivot axis 338 and is further received in openings formed in the first locking mechanism 308. The pin 336 may be secured or coupled to the first locking mechanism 308 via a retaining ring 1320. Thus, the spring support 332 and first end of the spring 330 is pivotably coupled to the first locking mechanism 308 about the second pivot axis 338. As such, pivotal movement of the spring 300 and spring support 332 can enable a proper alignment of the spring 330.

The retainer 334, or spring retainer, may be coupled to the side plate 1300 of FIG. 13. The side plate may include a pair of holes for fastening the retainer 334 thereto. As shown in FIG. 13, the retainer 334 may be received within a larger opening defined in the side plate 1300, and a washer 1324, retainer plate 1322, and fasteners 1326 may further be used for coupling the retainer 334 to the side plate 1300. In the illustrated embodiments, the retainer 334 may be fixedly coupled to the side plate 1300. However, in other embodiments, the retainer 334 may be pivotably or otherwise movably coupled to the side plate 1300.

As shown best in FIG. 3, a cap screw 340 or other fastener may be threadedly coupled to the retainer 334. During the assembly process, the spring 330 may be under significant strain. Thus, to enable the assembly and disassembly thereof, the cap screw 340 may be used to collapse the spring 330. The retainer 330 may therefore be drilled and tapped to support the use of a cap screw in the assembly and disassembly processes.

Referring to FIG. 3, the coupler assembly 210 is shown in its coupled or locked position 300. In this position, the coupler assembly 210 is coupled to the second pin 214 of the work tool 202. The first locking mechanism 308 is in a first or coupled position and the second locking mechanism 310 is in its locked position. In the locked position, the tab 314 of the second locking mechanism 310 may be disposed behind or to the rear of the first locking mechanism 308. As such, the first locking mechanism 308 is unable or blocked from pivoting about the first pivot axis 328. Moreover, the pin 312 of the second locking mechanism 310 is disposed axially inward (i.e., the axial inward position being into the page of FIG. 3). Thus, the first locking mechanism 308 remains coupled to the second pin 214.

Also in the coupled position 300 of FIG. 3, the spring 330 is positioned below a first axis 324. The first axis 324 is shown passing through the first pivot axis 328 and the second end of the spring 330. As will be described below, the position of the spring 330 relative to this first axis 324 will change as the coupler assembly 210 is coupled to and decoupled from the work tool 202.

In the coupled position 300 of FIG. 3, the first pin 212 of the work tool 202 is disposed within the second cavity 342 formed by the hook arm 344 of the coupler assembly 210. The orientation of the coupler assembly 210 may be such that it is disposed at an acute angle relative to a horizontal axis (not shown) passing through the pivot axis 328. This provides sufficient support for coupling the work tool 202 to the machine.

Figure 14:
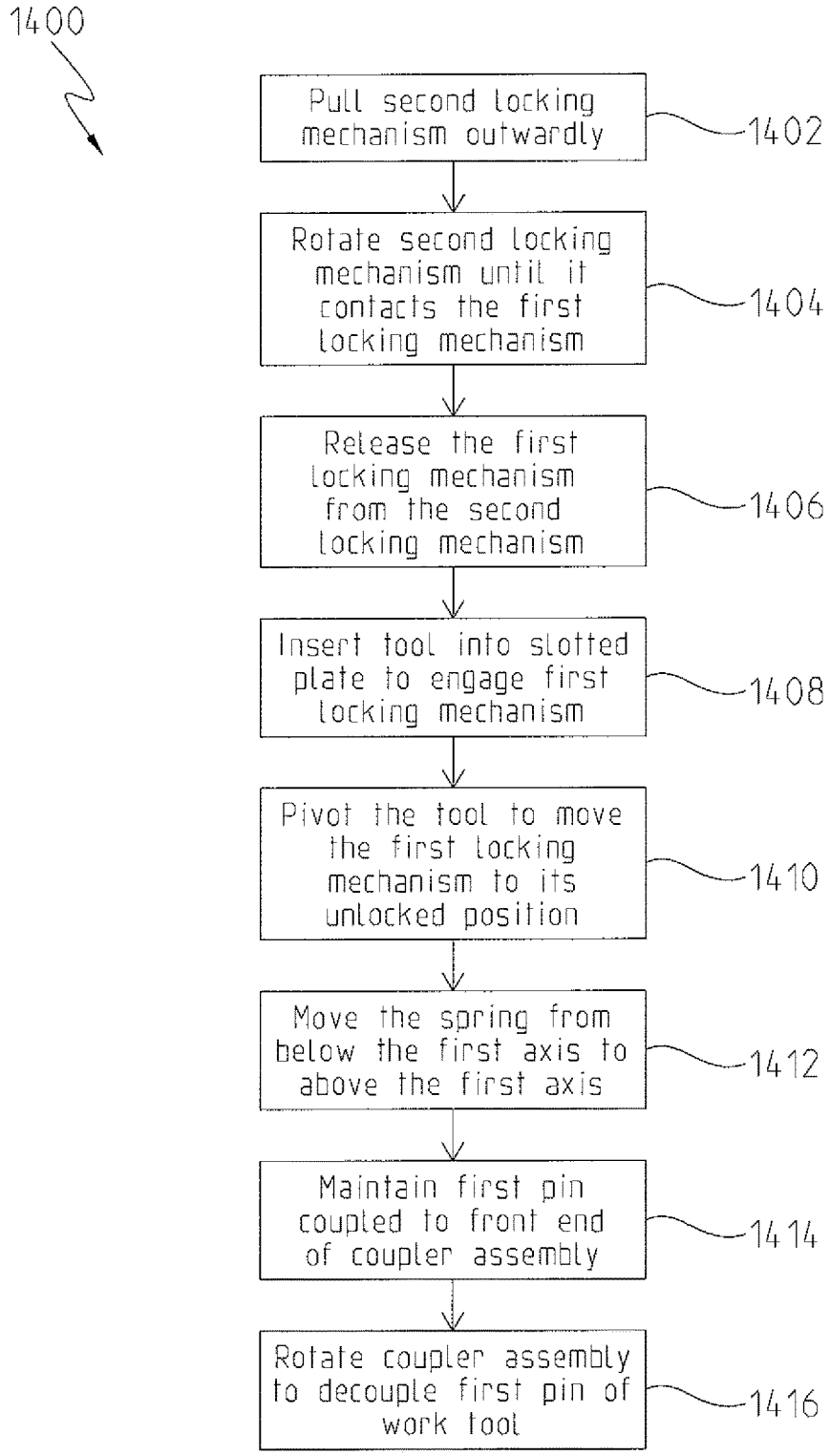
FIG. 14 is a flowchart illustrating one example of decoupling a work tool from the coupler assembly of FIG. 3.

In order to release the work tool 202 from the coupler assembly 210, one example of a method 1400 for doing so is shown in FIG. 14. This example provides a number of blocks for executing the method. One skilled in the art will appreciate that some of these steps may not be required in other examples, whereas additional steps may be executed in further examples. Thus, FIG. 14 is intended to be a non-limiting example of how to release or decouple the work tool 202 from the coupler assembly 210.

In block 1402, the handle on the second locking mechanism 310 may be pulled axially outward so that the pin 312 and tab 314 are no longer positioned directly behind or to the rear of the first locking mechanism 308. For instance, in FIG. 11, the pin 312 and tab 314 are shown disposed in an axially inward position 1100. In this position 1100, the tab 314 and at least part of the pin 312 is disposed rearward or behind a rear surface 1102 (i.e., trailing edge 902 of FIG. 9) of the first locking mechanism 308. This axially inward position 1100 of the pin 312 and tab 314 is referred to as the locked position of the second locking mechanism 310. In effect, the second locking mechanism 310 at least partially obstructs or prevents the first locking mechanism 308 from rotating from its position in FIG. 11 to its position in FIG. 5, which is described in further detail below.

Figure 11:
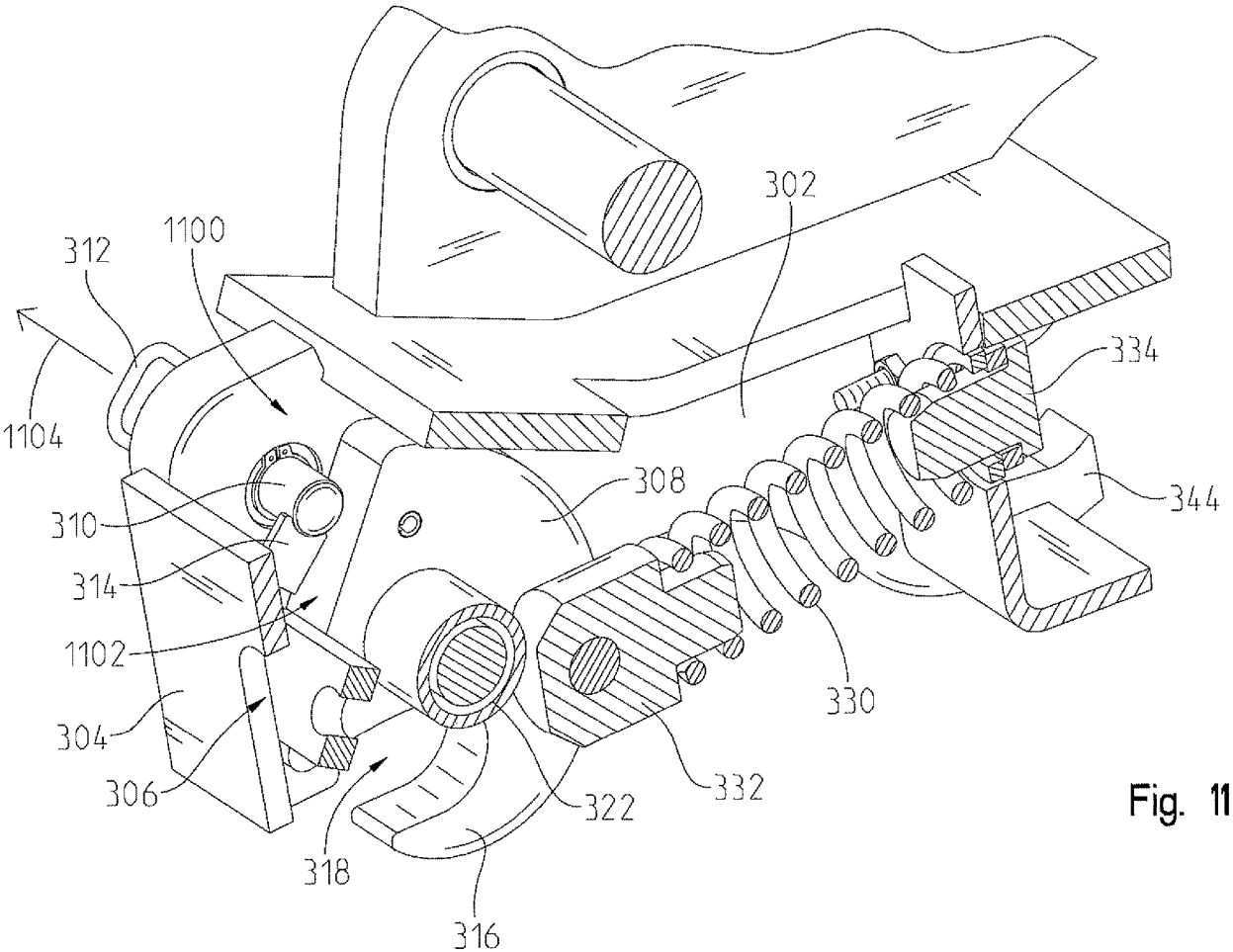
FIG. 11 is a side perspective and cross-sectional view of the coupler assembly of FIG. 3 in a coupled position.

In block 1402, the pin 312 and tab 314 of the second locking mechanism 310 are pulled axially outward in a direction indicated by arrow 1104 in FIG. 11. This releases the first locking mechanism 308 from being disposed in a locked position in block 1406. In other words, with the second locking mechanism 310 moved axially outwardly, a path by which the first locking mechanism 308 may pivot in a counterclockwise direction is vacated and thus unobstructed.

Figure 4:
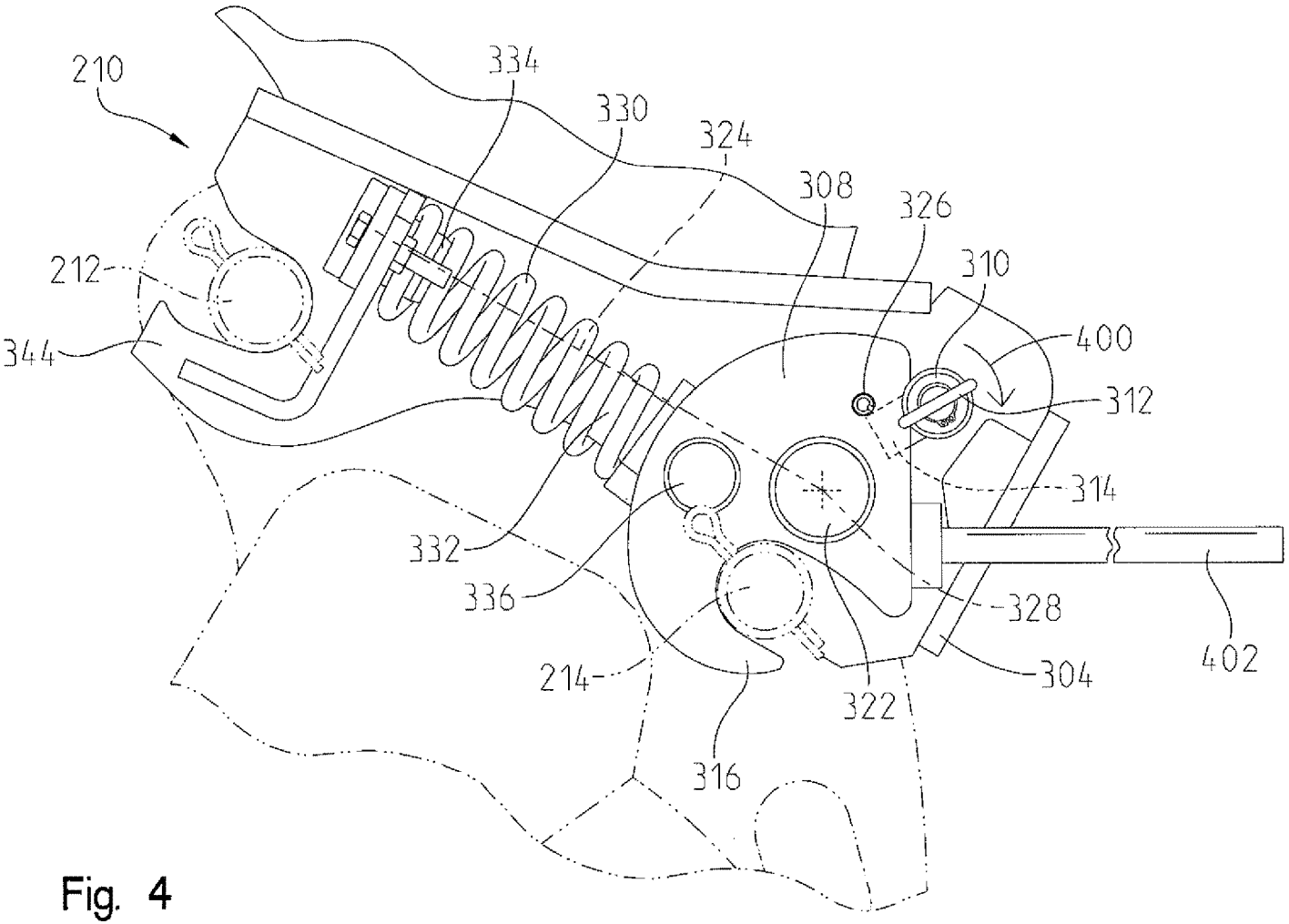
FIG. 4 is another partial side view of the coupler assembly of FIG. 3.
Figure 12:
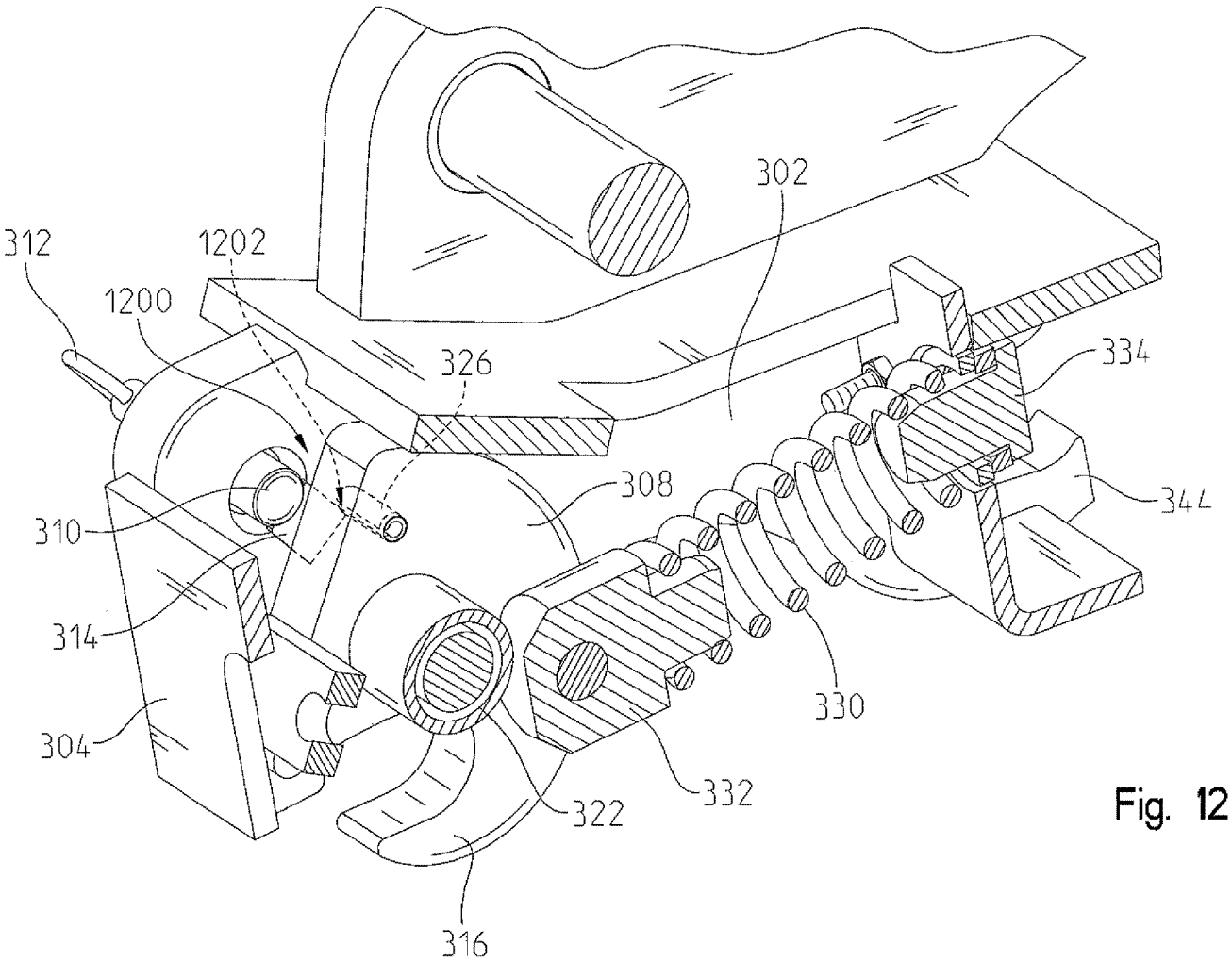
FIG. 12 is a side perspective and cross-sectional view of the coupler assembly of FIG. 3 in a decoupled position.

In this embodiment, however, the spring 1302 of the second locking mechanism 308 biases the pin 312 to return to its position of FIG. 3. Thus, in block 1404, the second locking mechanism 310 is rotated in a clockwise direction as shown by arrow 400 in FIG. 4. The second locking mechanism 310 may be rotated until the tab 314 comes into contact with a surface 1202 of the plug 326 as best illustrated in FIGS. 4 and 12. In this position, the second locking mechanism 310 is disposed in its unlocked position 1200 because the spring 1302 is compressed and forces the pin 312 and tab 314 axially inward and into contact with the first locking mechanism 308.

In its unlocked position of FIG. 4, the second locking mechanism 310 is also at least partially protruding outwardly further than it does in its locked position of FIG. 3. For example, the pin 312 may be displaced by one or more inches outward from the body 302 of the coupler assembly 210. The displacement may be more less in other examples, but the displacement of the second locking mechanism 310 provides a visual indication or confirmation to the machine operator that the second locking mechanism 310 has been unlocked. Similarly, when the second locking mechanism 310 is disposed in its locked position of FIG. 3, the second locking mechanism 310 is not displaced axially outward and this provides a visual indicator of the locked position.

Once the second locking mechanism 310 is moved to its unlocked position, the method 1400 may advance to block 1408 where the first locking mechanism 308 may be unlocked. To do so, a rod or other tool 402 may be inserted through the slot 306 in the first side plate 304 to engage the first locking mechanism 308. Once engaged, block 1410 may be executed such that the rod or tool 402 may be pivoted in a clockwise direction as indicated by arrow 502 in FIG. 5. The rotational movement of the rod or tool 402 induces a similar clockwise pivotal movement of the first locking mechanism 308 about the first pivot axis 328 to its unlocked position 500.

Figure 5:
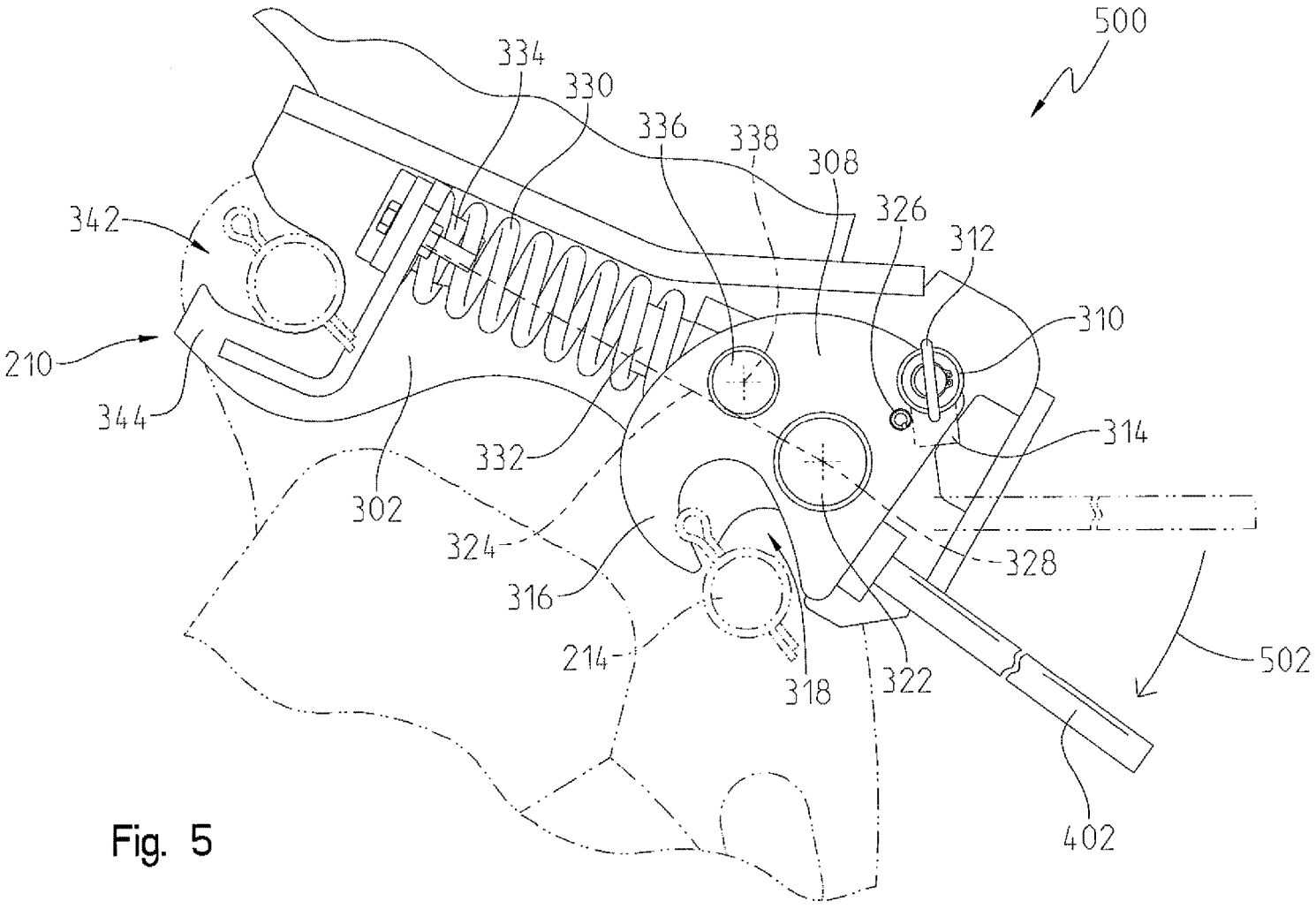
FIG. 5 is another partial side view of the coupler assembly being decoupled from the work tool.

In the unlocked position 500 of FIG. 5, the cavity 318 is oriented at least partially towards the ground (i.e., downwardly). In some aspects, the cavity 318 may be disposed at an angle relative to a vertical axis (not shown) passing through the first pivot axis 328. In any event, the first locking mechanism 308 is pivoted to a position where the second pin 214 may be released therefrom. Given the weight of the work tool 202, the second pin 214 may slide or otherwise move out of the cavity 318. This is further possible because the first pin 212 is still coupled to the front end of the coupler assembly 210, and the work tool 202 may be hanging or disposed therefrom off the ground by several inches or more.

In addition, in block 1412 the position of the spring 330 changes from the coupled or locked position of FIG. 3 to the decoupled or unlocked position of FIG. 5. In FIG. 5, the spring 330 is now positioned above the first axis 324. In the position of FIG. 5, the spring 330 may act like a detent to maintain the first locking mechanism 308 in its unlocked or open position.

Although not shown in detail, the pin 312 of the second locking mechanism 310 may include a chamfer at its end. In addition, the first locking mechanism 308 may include a chamfer or ramp formed therein to facilitate a smooth movement of the pin 312 and first locking mechanism 308 during pivotal movement of the first locking mechanism 308. The chamfer and ramp may not be included in other embodiments. Moreover, this pivotal movement may induce movement in the second locking mechanism 310, and in particular, the pin 312. The pin 312, for example, may be further pushed outwardly as the plug 326 moves. In some instances, this repositions the second locking mechanism 310 in an intermediate position or "ready to lock" position. Thus, as will be described, the second locking mechanism 310 is moved to a position to be triggered or released to its locked position.

Figure 6:
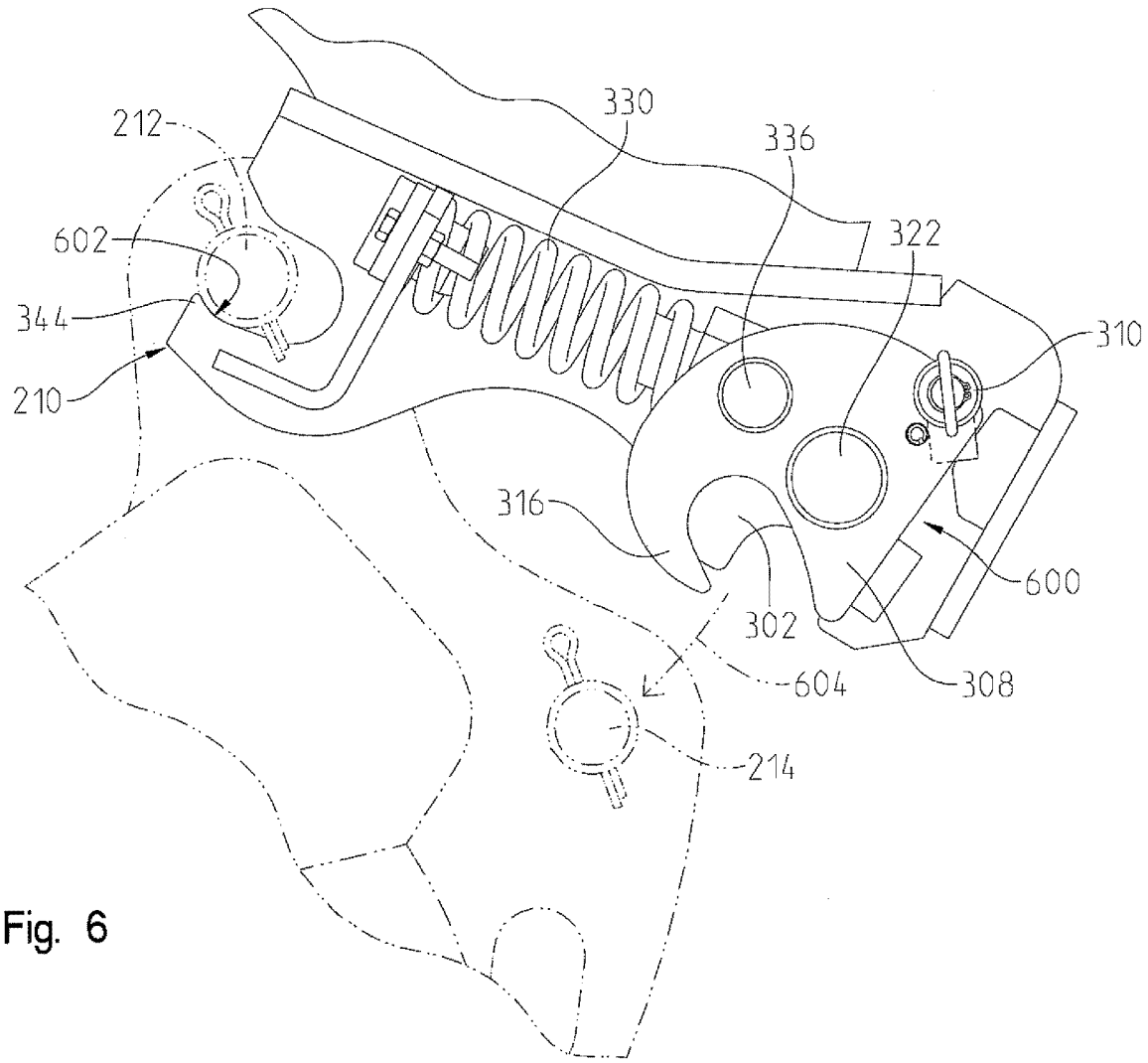
FIG. 6 is another partial side view of the coupler assembly being decoupled from a rear pin of the work tool.

As illustrated in FIG. 6, the first locking mechanism 308 is disposed in a second position 600 (i.e., unlocked or open position) such that the second pin 214 is released therefrom. In this position 600, the finger portion 316 of the first locking mechanism 308 is disposed between the body 302 and the second pin 214 so that the second pin 214 cannot be simply re-engaged. Also in this position, the first pin 212, however, remains engaged in the second cavity 342 and in contact with the hook arm 344. The hook arm 344 may form a lower lip 602 that has a concave-like shape in this position 600. In block 1414, this concave-like shape can prevent the first pin 212 from sliding or otherwise moving out of the cavity 342. This partial coupling is further maintained as the weight of the work tool 202 causes the second pin 214 to release from the rear end of the coupler assembly 210 and travel along an arc-shaped path 604.

Figure 7:
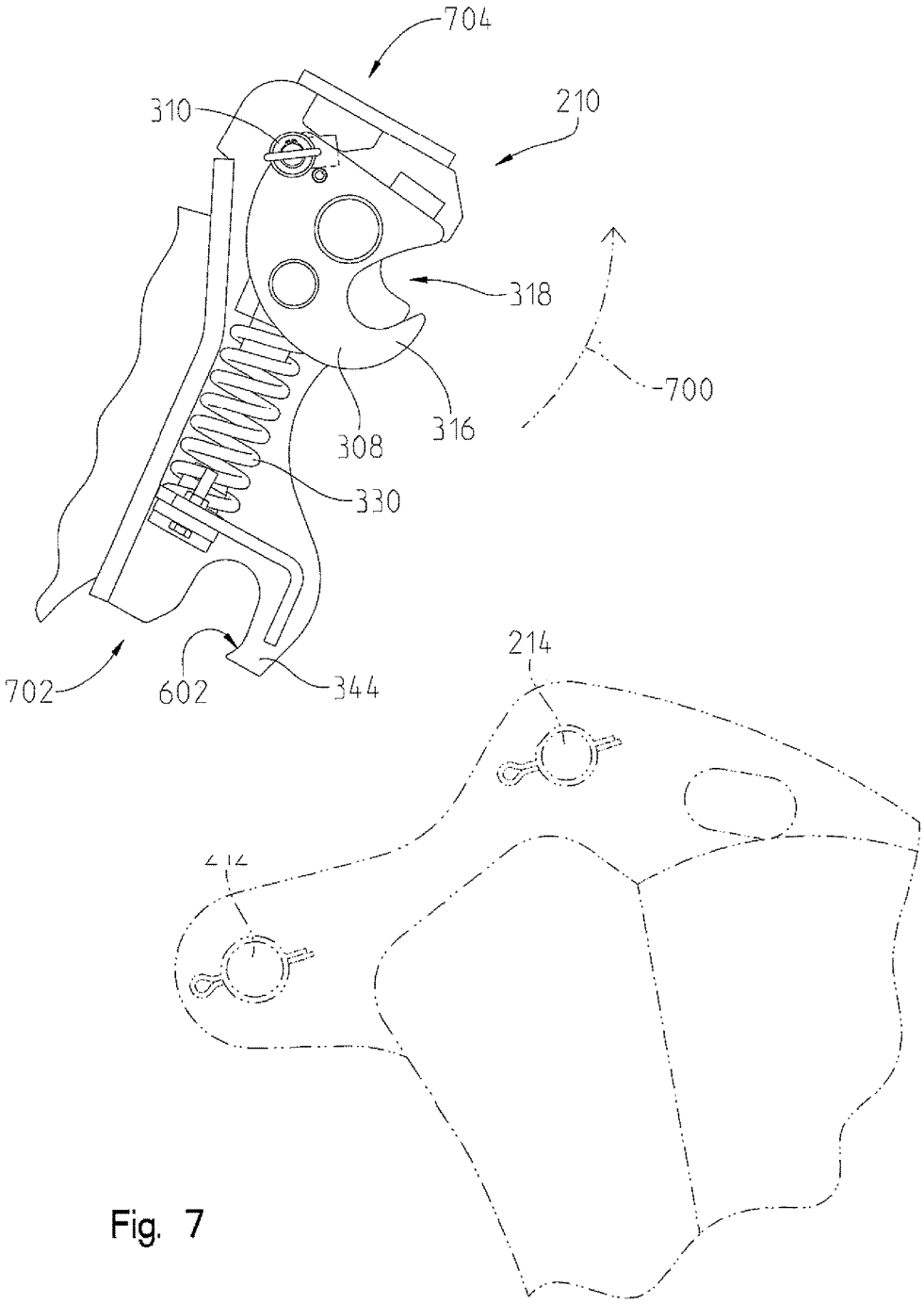
FIG. 7 is another partial side view of the coupler assembly being decoupled from the work tool.

To decouple the first pin 212 from the coupler assembly 210, the method 1400 can advance to block 1416 whereby the entire coupler assembly 210 is rotated in a counterclockwise direction indicated by arrow 700 in FIG. 7. As such, the coupler assembly 210 is oriented such that its front end 702 is disposed downwardly and its rear end 704 is disposed upwardly. In the illustrated embodiment of FIG. 7, the work tool 202 is disengaged from the coupler assembly 210.

Figure 8:
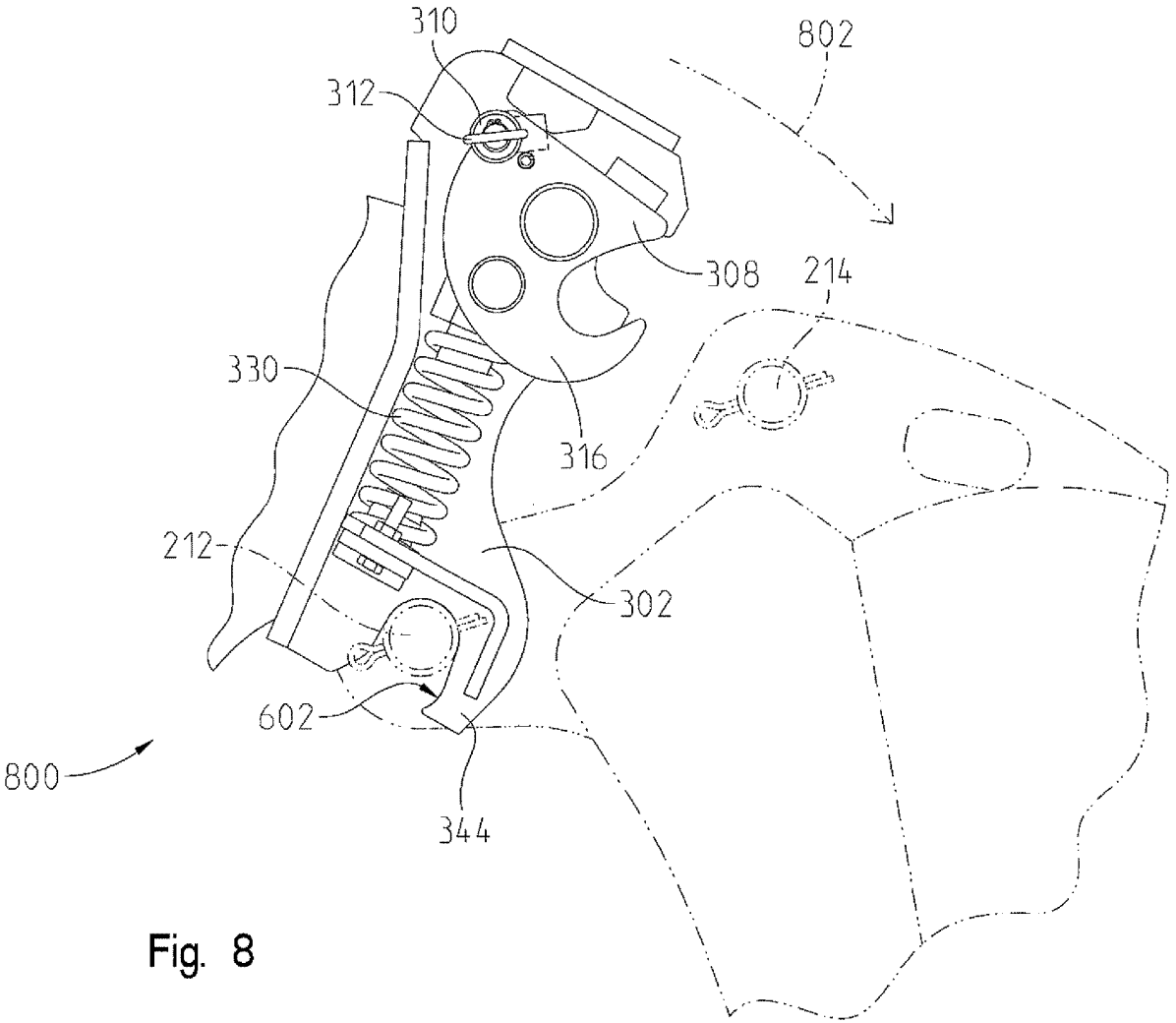
FIG. 8 is a partial side view of the coupler assembly being coupled to a front pin of the work tool.
Figure 9:
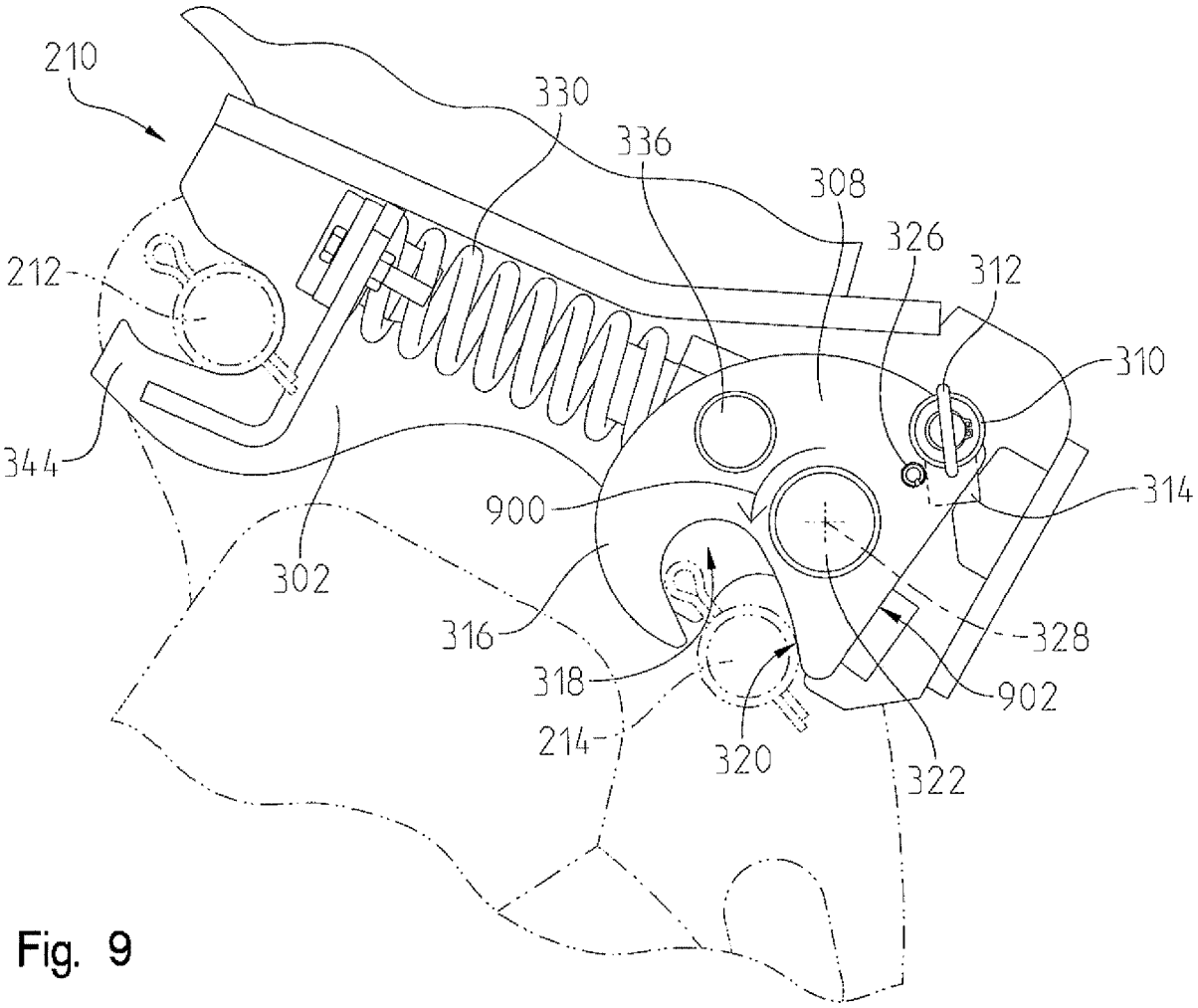
FIG. 9 is a partial side view of the coupler assembly being coupled to a rear pin of the work tool.
Figure 15:
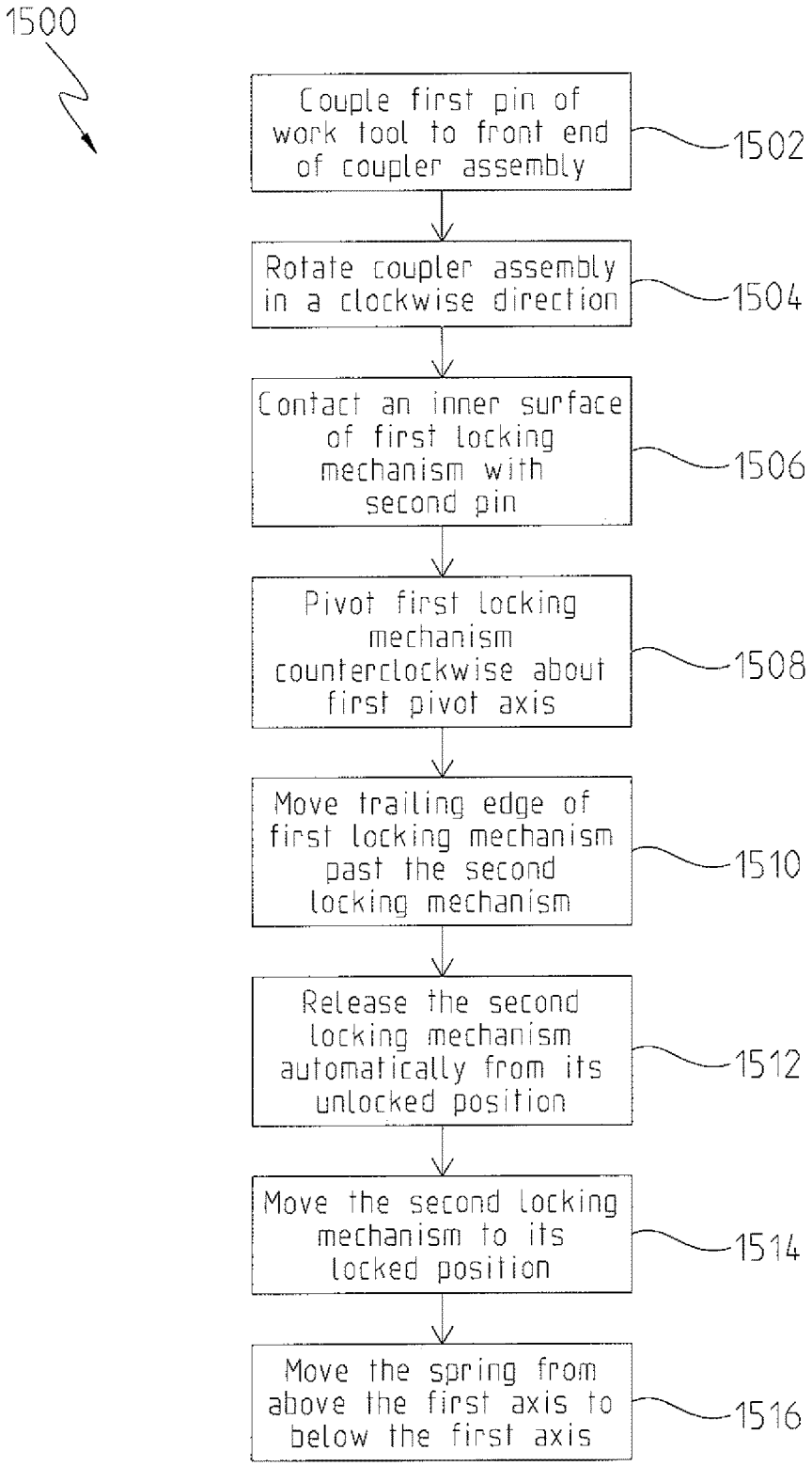
FIG. 15 is a flowchart illustrating one example of coupling a work tool to the coupler assembly of FIG. 3.

Referring now to FIG. 15, one example of a method 1500 for coupling a work tool to a machine is illustrated. Here, the work tool 202 and coupler assembly 210 are illustrated in FIG. 8 as well. The method 1500 may include a number of executable blocks for coupling the work tool 202 and coupler assembly 210. In a first block 1502 of the method 1500, the first pin 212 of the work tool 202 may be engaged to the front end 702 of the coupler assembly 210. To do so, the coupler assembly 210 may be controllably moved via the hydraulic actuator 208, which is controlled by the machine operator. The hook arm 344 may be oriented in a position 800 of FIG. 8 such that the first pin 212 is received within the cavity 342 formed in the front end 702 of the coupler assembly 210. Once the pin is received in the cavity, block 1504 may be executed to rotate the coupler assembly 210 in a clockwise direction indicated by arrow 802.

As the coupler assembly 210 is rotated in the clockwise direction 802, block 1506 may be executed whereby an inner cavity surface 320 of the first locking mechanism 308 comes into contact with the second pin 214. Once the first locking mechanism 308 contacts the second pin 214, further movement of the second pin 214 into the cavity 318 urges the first locking mechanism 308 to pivot about the first pivot axis 328 in a counterclockwise direction indicated by arrow 900 of FIG. 9.

The coupling method 1500 may advance to block 1510 where the first locking mechanism 308 continues to pivot about the first pivot axis 328 until a trailing edge 902 thereof passes by the second locking mechanism 310. As it passes the second locking mechanism, the pin 312 or tab 314 release from contact with the first locking mechanism 308 in block 1512 to thereby trigger the second locking mechanism 310 to automatically move from its unlocked position to its locked position of FIG. 3. In other words, the spring 1312 of the second locking mechanism 310 is released in block 1512 and automatically biases the pin 312 and tab 314 axially inward to their respective locked positions. In the locked position 1000 of FIG. 10, the tab 312 is now disposed directly behind or rearward of the first locking mechanism 308 so that the first locking mechanism 308 is prevented from pivoting to its unlocked position.

Figure 10:
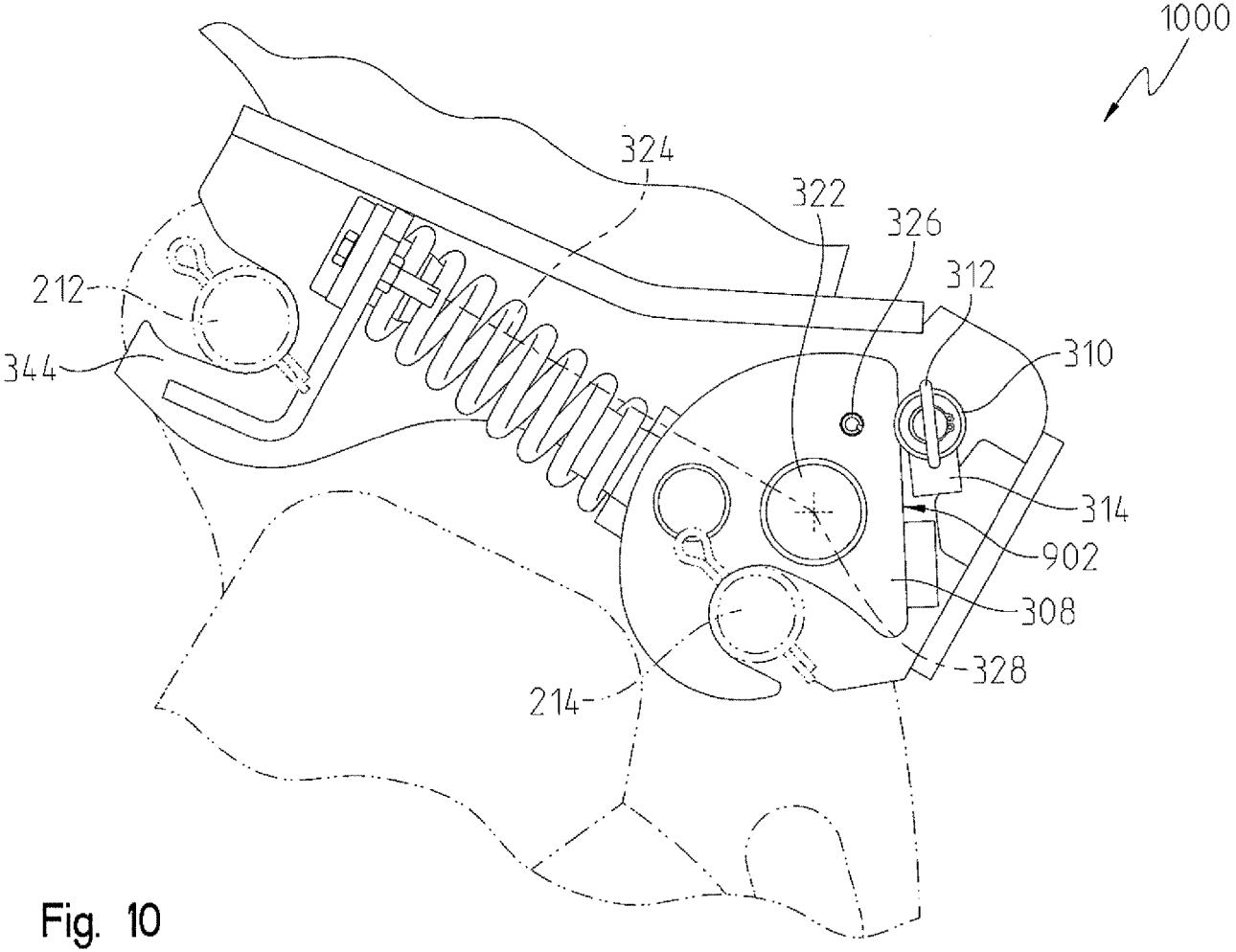
FIG. 10 is another partial side view of the coupler assembly being partially coupled to the work tool.

In FIG. 10, the second pin 214 is again engaged by the first locking mechanism 308 and disposed within the cavity 318. In this position, the method executes block 1516 such that the spring 330 again is moved to a position from above the first axis 324 to a position below the first axis 324 to further lock or secure the second pin 214 to the coupler assembly 210. In this method 1500, it is noteworthy that no operator intervention is required to lock the second locking mechanism 310. In other words, in the aforementioned method and design, the second locking mechanism 310 can automatically be released from its unlocked position to its locked position. The only intervention in this embodiment is when the second locking mechanism 310 is moved from its locked position to its unlocked position.

The aforementioned methods are intended only to be examples for coupling and decoupling the coupler assembly 210 to a work tool. The work tool 202 is shown and described as being a bucket, but it may be a blade or any other form of work tool. Moreover, the coupler assembly 210 may be coupled to any type of work machine. While a backhoe loader is shown and described herein, this is only intended to be one example of a work machine that incorporates the structure and function of the coupler assembly 210.

While embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A coupler assembly for coupling a work tool to a work machine, comprising:

a body having a front end and a rear end;

a first locking mechanism pivotable about a pivot from a first position to a second position, the first locking mechanism configured to be coupled to the work tool in the first position and decoupled in the second position; and a second locking mechanism including a pin having a first end and a second end, a tab coupled to the pin proximate the second end, and a spring disposed between the first end and the second end, where the second locking mechanism is axially and pivotably movable about an axis;

wherein, the second locking mechanism is movable between a locked position and an unlocked position;

further wherein, as the first locking mechanism moves from the second position to the first position, the second locking mechanism automatically moves to the locked position.

2. The coupler assembly of claim 1, wherein in the locked position, the first locking mechanism is maintained in the first position.

3. The coupler assembly of claim 1, wherein as the second locking mechanism is moved from the locked position to the unlocked position, the pin is axially moved to an outward position from its locked position and the tab is rotated to a position whereby at least one of the second end and the tab is in contact with the first locked mechanism to maintain the pin in the outward position.

4. The coupler assembly of claim 1, wherein in the unlocked position, the first locking mechanism is movable between the first and second positions.

5. The coupler assembly of claim 1, further comprising a second spring coupled to the first locking mechanism.

6. The coupler assembly of claim 5, further comprising:

a spring support pivotably coupled to the first locking mechanism; and a retainer fixedly coupled to the body;

wherein, the second spring is disposed between the spring support and retainer.

7. The coupler assembly of claim 5, wherein the body defines longitudinal axis that passes through the pivot;

further wherein, the second spring is disposed below the axis in the first position and above the axis in the second position.

8. The coupler assembly of claim 7, wherein the first locking mechanism remains in the second position when the second spring is disposed above the axis.

9. The coupler assembly of claim 1, wherein the second locking mechanism automatically moves to its locked position once a trailing edge of the first locking mechanism moves past the pin and the pin is releasably disengaged from contacting the first locking mechanism.

10. The coupler assembly of claim 9, wherein the spring biases the pin from its outward position to an inward position once the pin is no longer in contact with the first locking mechanism.

11. The coupler assembly of claim 1, further comprising a hook portion defined at the front end of the body, the hook portion configured to be releasably coupled to the work tool.

12. The coupler assembly of claim 11, wherein in the second position, the hook portion is coupled to the work tool until the body is rotated to a position that releases the work tool from the hook portion.

13. A work machine, comprising:

a frame supported by at least one ground-engaging mechanism;

a cab mounted to the frame, the cab including at least one control element for controlling a function of the machine;

a work tool controllable for performing a work function;

a coupler assembly for coupling the work tool to the work machine, the coupler assembly comprising:

a body having a front end and a rear end;

a first locking mechanism pivotable about a pivot from a first position to a second position, the first locking mechanism configured to be coupled to the work tool in the first position and decoupled in the second position; and a second locking mechanism including a pin having a first end and a second end, a tab coupled to the pin proximate the second end, and a spring disposed between the first end and the second end, where the second locking mechanism is axially and pivotably movable about an axis;

wherein, the second locking mechanism is movable between a locked position and an unlocked position;

further wherein, as the first locking mechanism moves from the second position to the first position, the second locking mechanism automatically moves to the locked position.

14. The work machine of claim 13, wherein as the second locking mechanism is moved from the locked position to the unlocked position, the pin is axially moved to an outward position from its locked position and the tab is rotated to a position whereby at least one of the second end and the tab is in contact with the first locked mechanism to maintain the pin in the outward position.

15. The work machine of claim 13, wherein:

the body defines a longitudinal axis that passes through the pivot and the second spring is disposed below the axis in the first position and above the axis in the second position; and the first locking mechanism remains in the second position when the second spring is disposed above the axis.

16. The work machine of claim 13, wherein the second locking mechanism automatically moves to its locked position once a trailing edge of the first locking mechanism moves past the pin and the pin and tab are releasably disengaged from contacting the first locking mechanism.

17. A coupler assembly for coupling a work tool to a work machine, comprising:

a pair of longitudinal bodies having a front end and a rear end;

a plate coupled between the pair of bodies at the rear end thereof, wherein the plate includes a slot defined therein;

a hook portion formed at the front end of the pair of bodies, the hook portion defining a first cavity adapted to receive to a first pin of the work tool;

a first locking mechanism defining a plurality of openings and including a finger portion, the finger portion partially defining a second cavity adapted to receive a second pin of the work tool;

a pivot pin disposable in one of the plurality of openings of the first locking mechanism, the pivot pin pivotably coupling the first locking mechanism to the pair of bodies to enable the first locking mechanism to pivot about a first pivot axis;

a first spring having a first end and a second end, the first end being pivotably coupled to the first locking mechanism about a second pivot axis; and a second locking mechanism including a pin having a first end and a second end, a tab coupled to the pin proximate the second end, and a second spring disposed between the first and the second ends, where the second locking mechanism is axially and pivotably movable about an axis;

wherein, the first locking mechanism is pivotable about the first pivot axis between a first position and a second position, and the second locking mechanism is movable between a locked position and an unlocked position;

further wherein:

in the first position, the first locking mechanism is configured to be coupled to the second pin of the work tool and the tab is disposed to the rear of the first locking mechanism to block the first locking mechanism from pivoting from its first position and the second locking mechanism is disposed in its locked position;

in the second position, the first locking mechanism is pivotably displaced from the first position such that the finger portion is configured to be at least partially disposed between the pair of bodies and the second pin, and the second locking mechanism is disposed axially outward in its unlocked position and in contact with the first locking mechanism.

18. The coupler assembly of claim 17, further comprising:

a spring support pivotably coupled to the first locking mechanism; and a retainer fixedly coupled to the pair of bodies;

wherein, the first spring is disposed between the spring support and retainer.

19. The coupler assembly of claim 18, wherein one of the pair of bodies defines a longitudinal axis that passes through the first pivot axis;

further wherein, the first spring is disposed below the longitudinal axis in the first position and above the longitudinal axis in the second position.

20. The coupler assembly of claim 17, wherein the second locking mechanism automatically moves to its locked position from its unlocked position once a trailing edge of the first locking mechanism moves past the pin, the pin is releasably disengaged from contacting the first locking mechanism, and the second spring biases the second locking mechanism inwardly such that the tab is disposed rearward of the first locking mechanism.

* * * * *